United States Patent [19]

Otteblad et al.

[11] Patent Number: 4,498,408

[45] Date of Patent: Feb. 12, 1985

[54] LIFTING BODY FOR DIVING

[75] Inventors: Sven I. Otteblad, Partille; Ralph G. Dovertie, Gothenburg, both of Sweden

[73] Assignee: Aquastat AB, Gothenburg, Sweden

[21] Appl. No.: 398,884

[22] Filed: Jul. 16, 1982

[30] Foreign Application Priority Data

Jul. 17, 1981 [SE] Sweden ..... 8104428

[51] Int. Cl.[3] ..... B63C 7/10

[52] U.S. Cl. ..... 114/52; 114/54; 244/97; 244/98; 244/99

[58] Field of Search ..... 114/52–54, 114/50; 244/96–99

[56] References Cited

U.S. PATENT DOCUMENTS

| | | | |
|---|---|---|---|
| 2,313,215 | 3/1943 | Bierlee | 114/54 |
| 2,635,574 | 4/1953 | Sturtevant | 114/54 |
| 2,742,246 | 4/1956 | Mellen | 244/97 X |
| 3,112,900 | 12/1963 | Yost | 244/97 X |

FOREIGN PATENT DOCUMENTS 79099875 6/1981 Sweden .

OTHER PUBLICATIONS

An article from "Svensk Sjofarts Tidnig" (Swedish Journal of Navigation) No. 37 of 1978.

*Primary Examiner*—Sherman D. Basinger

*Attorney, Agent, or Firm*—Cushman, Darby & Cushman

[57] ABSTRACT

Lifting body for transporting or lifting objects under water, of the type in which the lifting gas has essentially the same pressure as the surrounding mass of water. The lifting body comprises a pressure measuring instrument which provides a depth position signal, which is arranged to be compared with a desired depth signal and produces a signal which indicates the required force for controlling the position. The desired thus computed command value is compared with the actual exerted lifting force, via a dynamometer, the signal of which is sent via a high pass filter. By thus arranging a double control system with a position loop and a force loop, it is possible to achieve stable control.

30 Claims, 6 Drawing Figures

LIFTING BODY FOR DIVING

FIELD OF THE INVENTION

The invention relates to a lifting body for transporting, lifting, or lowering objects through a first fluid (such as water), provided with means for changing the lifting force exerted by a second liquid (such as supplying and removing a lifting gas). It is of the type in which the lifting gas has essentially the same pressure as the surrounding mass of water, and it includes a measuring instrument for providing a depth position signal.

BACKGROUND OF THE INVENTION

A common type of lifting body consists of a closed, rigid tank which is filled to a controllable amount with a lifting gas. Such a lifting body has a fixed volume which is not variable if the lifting body is placed at different depths. The invention relates, however, to lifting bodies in which the lifting gas assumes approximately the same pressure as the surrounding mass of water. Examples of such lifting bodies are balloons and also rigid lifting bodies in which the enclosed mass of water is in uninterrupted communication with the mass of water lying outside.

Lifting bodies of the type described above are known and used for recovering heavy objects from the sea floor for example. Previous attempts to make them vertically controllable by regulating the gas supply depending on the depth has met with little success.

There is the particular problem that such a lifting body is difficult to depth stabilize. A comparison might be made with the swimming bladder of a fish, which provides an unstable depth equilibrium, because a deviation upwards involves a reduction in pressure and an increase in volume, thus increasing the lifting force, and the reverse is true of a deviation downwards. Therefore, it has been a common understanding by persons skilled in the art that a lifting body of the type described above cannot be depth stabilized. We will now demonstrate that this understanding is in principle correct.

The block diagram in FIG. 1 illustrates a control system, in which a balloon 1 obtains air via a controlled valve 6. A position measuring instrument 2 (pressure meter or echo sounder) provides a position signal which is compared in a comparator 3 with a desired position signal, and the result is set to a regulator 4, which controls, via a transformer 5, the valve 6 for controlling the supply or removal of the air.

We assume that the regulator 4 is a proportional regulator.

Assume now that the balloon is at a certain depth X which agrees with the set desired position. We now change the set point to a higher desired level. The system then opens the valve 6, and more air is pressed into the balloon. The lifting force will increase in proportion to the added air (at least as long as the balloon does not rise apreciably). The increased amount of air causes the balloon to accelerate upwards, and the velocity increases as it moves, and the new set desired position will be reached. When the new desired position has been reached, the balloon, however, has been accelerated to a velocity so that the balloon passes the desired position. At that position, the valve 6 will of course cut off the supply of air and open the air release. The acceleration will, however, continue until the previously added air has been released, and only when the negative regulator error has become significantly greater than the positive starting position, will the acceleration upwards cease. The velocity is still directed upwards, however, and it is obvious that the balloon will continue further before it turns. The release of air and the movement downwards will proceed in a similar manner, and the balloon's next lower turning point will lie lower than the starting level. In this manner the oscillating amplitude of the balloon will become greater and greater.

The control equation for such a system can be written:

$$\frac{d^3y}{dt^3} + y = X(t)$$

in which y is the measured depth and X is the set value. Such a control system is instable.

Some improvement can be achieved if instead of a valve opening corresponding to the difference between the set and actual values (X-y), one works with a system which begins to release air even before the correct level has been passed (proportional and derivative regulator), but it is still not possible to make the system stable. Furthermore, the above reasoning has been simplified in a manner favoring stability, in that the expansion of the air when rising has been disregarded.

BRIEF SUMMARY OF THE INVENTION

It is a purpose of the present invention to achieve a lifting body of the type described in the introduction, which provides stable vertical control. This is achieved according to the invention by a lifting body which has the characteristics disclosed in claim 1.

A particularly appropriate method of achieving an acceleration measuring instrument for a lifting body intended to exert a lifting force on an object to be lifted via a rope for example, is to arrange a dynamometer which measures the force in the rope. The change in this force is essentially proportional to the acceleration for the system which consists of lifting body and object. It is also possible to arrange an accelerometer which measures the acceleration in a known manner by measuring an inertial force inside the accelerometer. At present, a pressure meter is preferred for measuring depths.

The invention thus achieves a stable control system by introducing an extra sensor. The position regulator, which in the previous design controlled the valve flow, controls instead the set point for a lifting force circuit.

FIG. 2 shows an example of a control circuit designed for the invention. The same reference numerals have been used in FIG. 2 for components corresponding to those in FIG. 1. An external control circuit, similar to that in FIG. 1, compares the position signal from the measuring instrument 2 with a set position in the comparator 3, which controls a regulator 4', which in this case, however, generates the signal for the desired force. In an inner control loop, the acceleration or force measuring instrument 7 produces a signal which is compared with the desired force signal in a comparator 8, and the out-signal therefrom controls a regulator 4'', the outsignal of which controls the air valve 6 via a converter 5. It is advisable to allow the signal from the dynamometer to pass through a high pass filter, meaning that the information concerning the change in the lifting force will be highly weighted. This provides several advantages:

1. The stability characteristics will be further improved.

2. The dependence on the absolute size of the load will be reduced.

3. A control system is obtained with high precision, which can balance an arbitrary load without problems with dimensioning the control range of the system.

4. It is possible to create a system which functions advantageously for pulling loose a load from the bottom, which will suddenly be dislodged from the bottom, thus suddenly reducing the force, and causing a great and sudden acceleration.

In accordance with a presently preferred embodiment, the lifting body is of balloon type with an open bottom, and an air hose goes from the balloon to a control unit above the surface with an air compressor/pump, which can press in, via a controllable valve, more air into the lifting body. Through another controllable valve, air can be released through the same hose. This embodiment functions well as long as the depth is reasonable, e.g. down to 30–60 meters. At greater depth, the weight and lifting force of the hose, and its limitation on the flow, will result in difficulties. It is then preferable to have a self-contained system without an air hose, and a gas source accompanying the lifting body under water. The gas source can, of course, be a tank with compressed air or the like, and one can either allow the gas to be consumed by allowing the gas source to blow in the gas and then allowing the gas to escape, or by allowing the released gas to be pressed back into the tank. It is preferable to use a vessel filled with liquid nitrogen, which is readily consumed, stored in a vessel of thermos bottle type.

BRIEF DESCRIPTION OF THE DRAWING

The invention will now be described in connection with a non-limiting example with reference to the drawings.

DETAILED DESCRIPTION OF PREFERRED EMBODIMENTS

Figure 6:
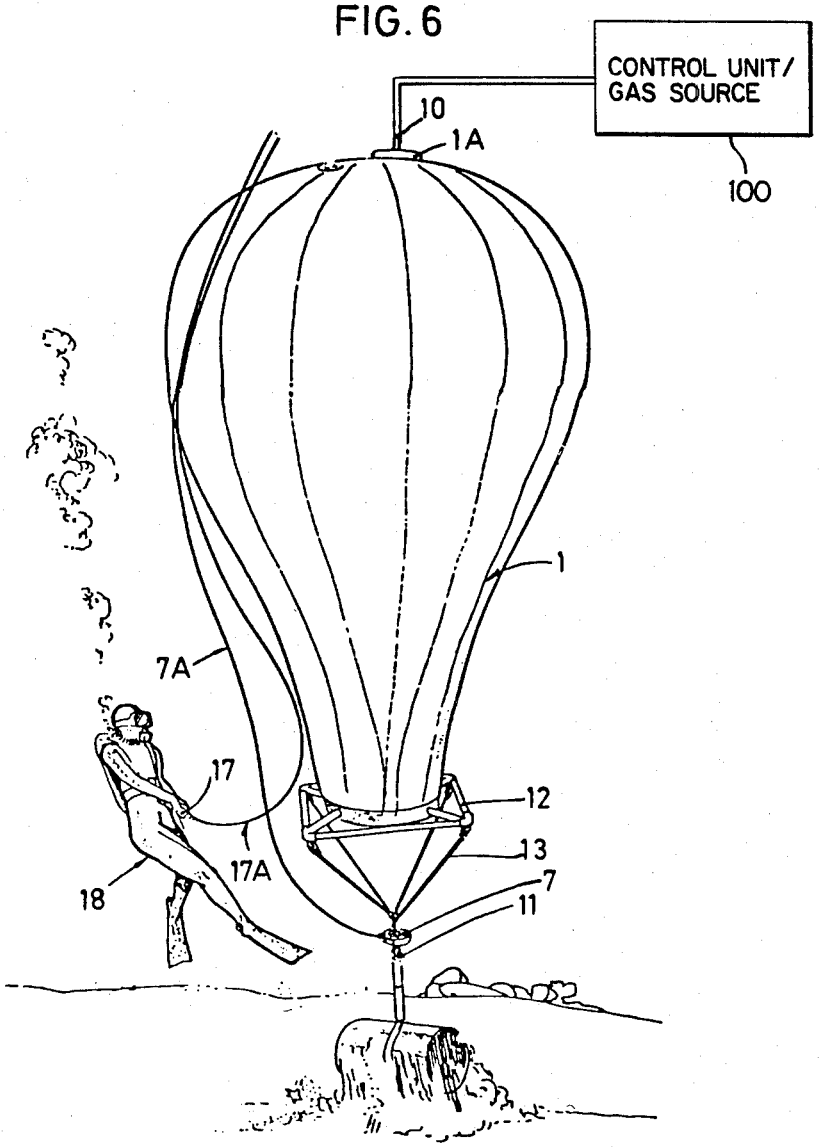
FIG. 6 schematically shows a lifting body, which is one embodiment of the invention.

FIG. 6 shows schematically a lifting body, functioning according to the invention. A balloon shaped body 1 of flexible material is provided with a lifting hook 11, and between the body 1 and the hook 11 there is a sensor 7, which is coupled via a line 7A to the automatic control means (not shown). As the lifting body is made, it is open like a skirt at the lower end and is kept open by a frame 12, which via lines 13 and the sensor 7 is connected to the lifting hook 11. The sensor 7 contains both a pressure sensor and a dynamometer for the force exerted by the hook 11. A diver 18 holds an operating control 17, which is connected by a cable 17A to the automatic control means. The lifting body obtains air via a hose 10, fixed at 1A to the lifting body 1. The air hose 10 goes to a control unit 100 above the surface with an air compressor/pump, which can force, via a controllable valve, more air into the lifting body 1. Alternatively, control unit 100 may accompany lifting body 1 under water and include a gas source. Although not shown, it is suitable to allow the cables 17A and 7A to pass inside the air hose 10.

Figure 3:
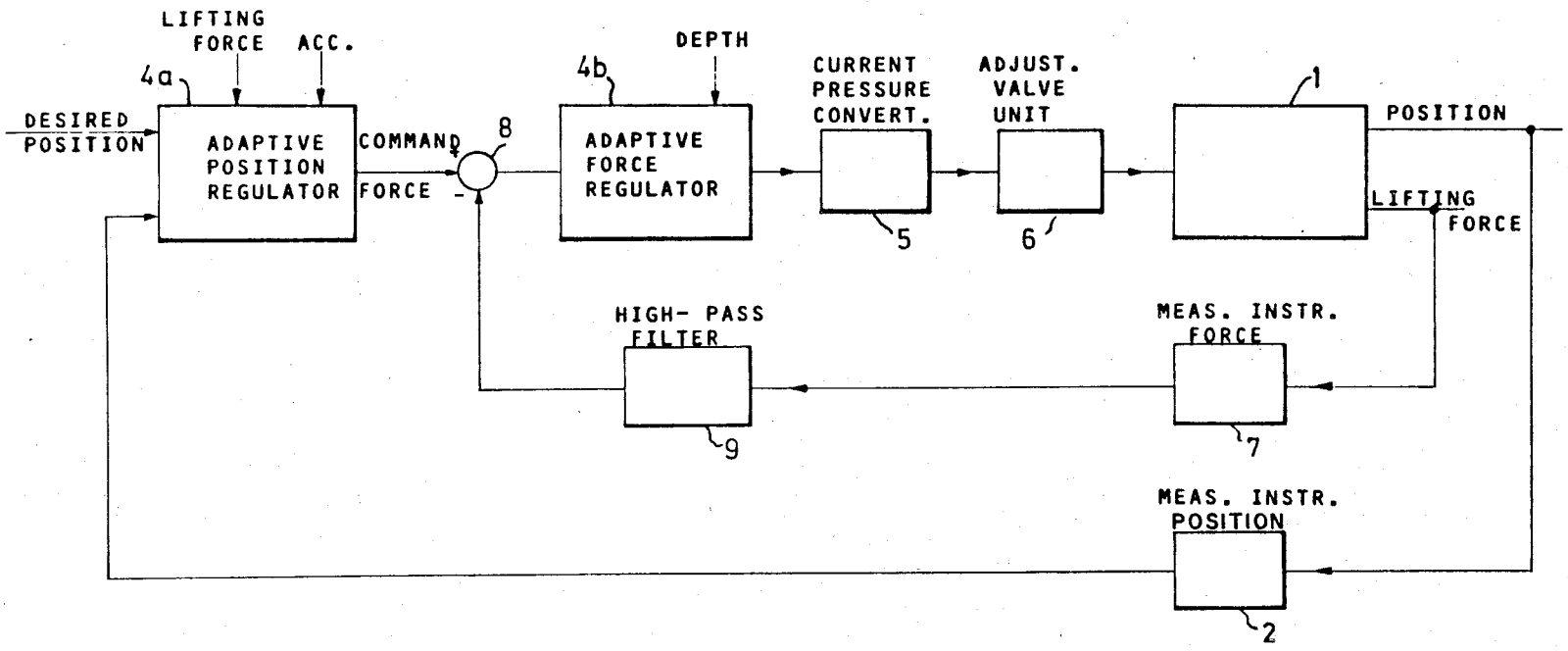
FIG. 3 shows a somewhat more complicated block diagram.
Figure 4:
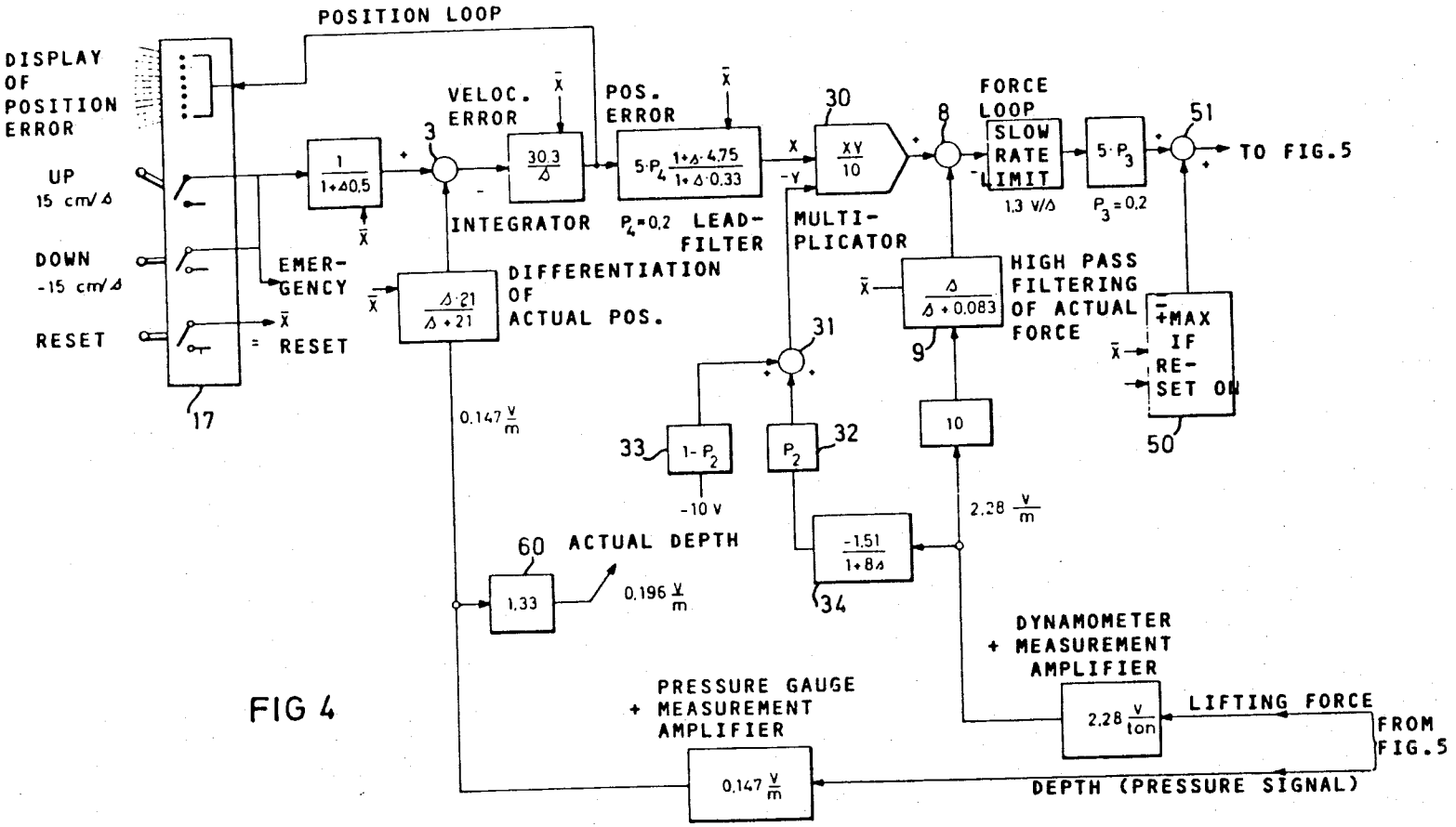
FIGS. 4 and 5 show a detailed block diagram of one embodiment of a control circuit.
Figures 5, 5A:
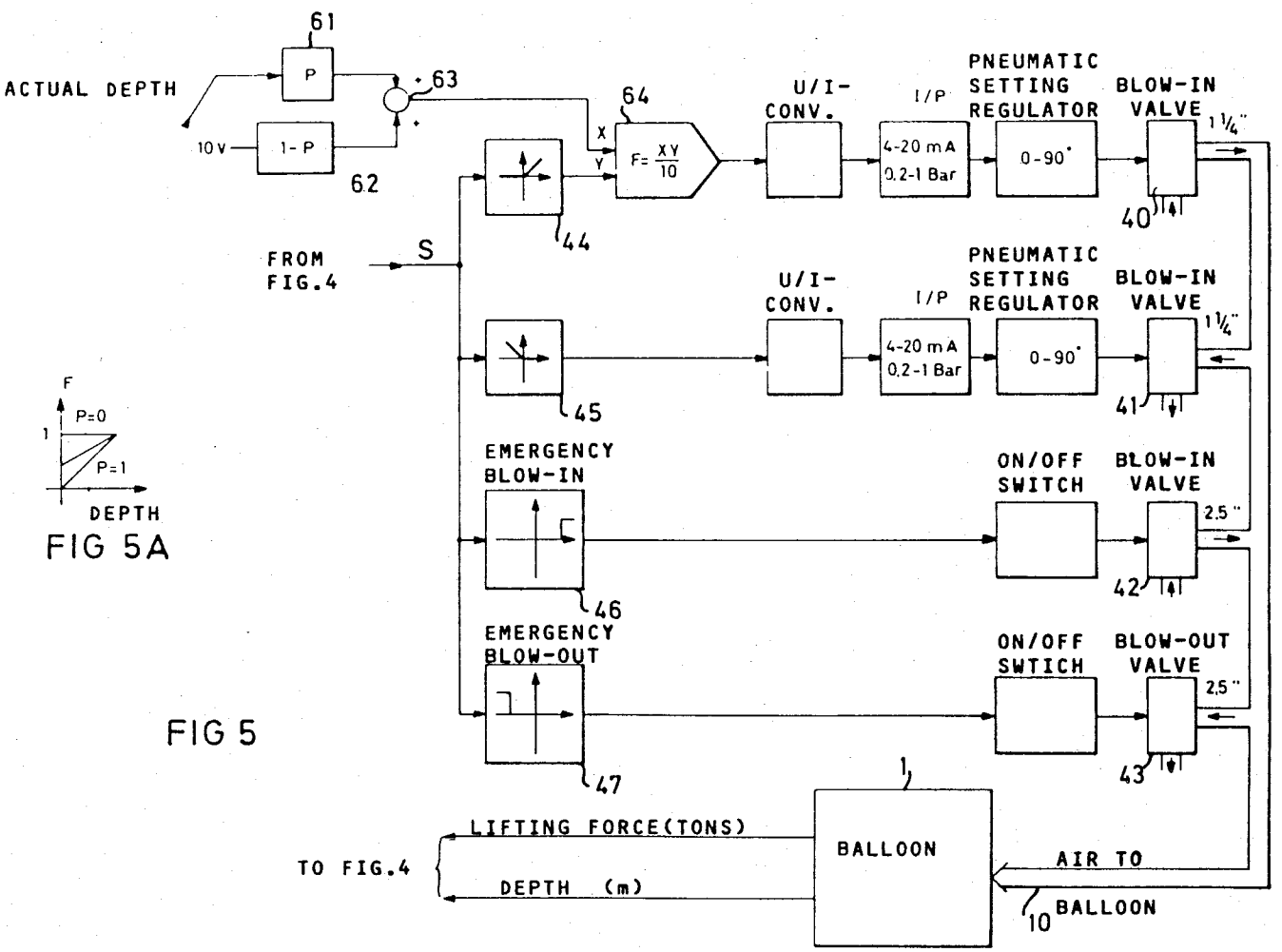
FIG. 5A shows how amplification varies with depth at values of $P=0$, $P=\frac{1}{2}$ and $P=1$.

The control circuit shown in FIGS. 4 and 5 is based on the control principle illustrated in FIG. 3 but is more detailed.

Two signals are emitted from the balloon 1, namely a force signal and a depth signal, both via 7A.

Figure 1:
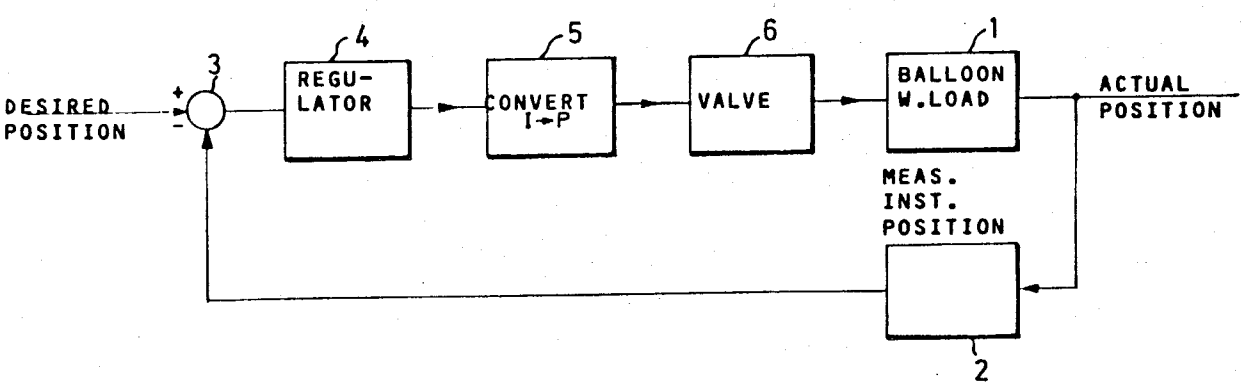
FIG. 1 PRIOR ART
FIG. 1 shows a block diagram of a simple control circuit of the type which cannot work as described above.
Figure 2:
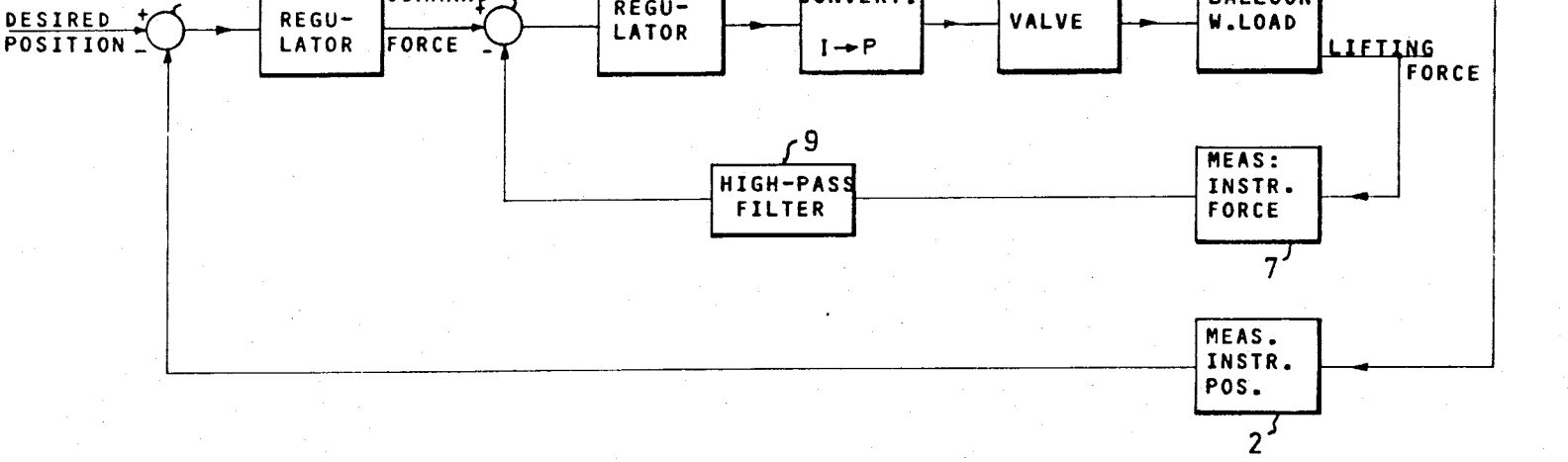
FIG. 2 shows a block diagram of a control circuit according to the invention.

To the control engineer, both of these figures are quite self-explanatory. A comparison with FIG. 2 reveals that the comparator 3 receives a command value signal which can be a ramp signal from the diver's operating means 17 for raising or lowering. This signal is compared to the differentiated depth signal (the pressure signal from 2), and the result is a velocity error. This is integrated so as to obtain a position error, which is processed in a so called lead-filter. FIG. 5 reveals how the signals to the point S control four air valves 40–43. Discriminating means 44–47 determine which valve is to be activated depending on the signal at point S. A moderate positive signal results in a signal proportional thereto which controls a pneumatically activated blow-in valve 40 to provide the hose 10 via a compressed air source with air for the balloon 1. It is suitable to make the blowing-in dependent on the depth in the manner shown. In a similar manner a moderate negative signal will result in the pneumatically controlled discharge valve 41 opening in response to the signal.

The valves 42 and 43 are only activated if the signal at point S exceeds or drops below predetermined levels. These valves only have a closed and completely open position and one of them 42, couples in the air source at full force, while the other releases the maximum air flow from the balloon 1.

We will now discuss the operating means 17 which the diver in FIG. 6 is holding in his hand, and which is shown at the far left in FIG. 4. It is provided with three hand operated controls, one for lifting, one for lowering and one for resetting. Activation of the lifting or lowering control will result in the command value for the velocity to the comparator 3 being positive or negative corresponding to a velocity of $\pm 15$ cm/sec. Activation of the resetting control results in a signal X being sent to the various integrating and differentiating means, the command value for the position being made equal to the current actual position. The lift device is controlled to stop at this level when the control is released. If the diver activates either the up or down control simultaneously with the reset control, an emergency signal is obtained through a circuit 50 which will be described in more detail below.

The position error in the regulator is shown on a luminous dial display in the control means which indicates to the diver the degree of precision and stability. Such luminous dial displays are previously known; the dials arranged in a row are led in sequence as the signal voltage increases, the row of dials thus functioning as a column in a fluid thermometer.

As revealed in FIG. 4, there is a special signal emitter, which is activated if the diver simultaneously activates either the up or down control and the reset control. The unit 50 then sends a maximum signal, positive or negative, depending on whether the up or down control has been activated, thereby activating either the valve 42 or the valve 43. The diver can thus bypass the control system and as needed, make the lifting balloon or lower at maximum rate.

In accordance with a preferred embodiment, the control constants can be effected by the load. This is done by allowing the lifting force signal, possibly in combination with an accelerometer signal via a filtering (delaying) circuit 34, to go through a circuit 31, 32, 33 with variably adjustable amplification $0<P_2<1$, forming a signal y, which is multiplied in a multiplier 30 by the position error signal X from the lead-filter.

It is also suitable to allow at least the air blow-in to be controlled in response to the depth in such a manner that its effect is increased at increasing depth. An amplifier 60 emits a signal "actual depth", which via an amplifier device 61, 62, 63 sends a control signal to the multiplier 64. The concept is the following: At a certain depth, e.g. 50 meters, the amplification should be 1 and lower at lesser depths. FIG. 5A shows how the amplification varies with the depth at values $P=0$, $P=\frac{1}{2}$, and $P=1$. It has proved most advantageous to set $P=\frac{1}{2}$ for best control.

The embodiment described above is one method of achieving an adaptive control. More generally, the effect on the control constants can be shown in block diagram form as in FIG. 3, where the same components have the same reference numerals as in the other figures. In a first adaptive amplifier 4*a*, the out-signal is made dependent on the lifting force and the acceleration, and the value of the acceleration can be obtained for a separate acceleration sensor. Alternatively, the amplification in unit 4*a* can be made dependent on the mass represented by the lifting body and the load. The regulator 4*b* is also adaptive and has an amplification factor dependent on the depth.

In FIGS. 4 and 5, the various amplification constants have been indicated in the usual manner for control engineering. The person skilled in the art will be able to reproduce such amplifiers by means of integrated circuit amplifiers, provided with components such as capacitors and resistors, and such a schematic circuit diagram is thus just as informative as more detailed circuit diagrams, in which the component's functions are much harder to grasp.

With present day integrated circuit technology and the possibility of numeric operation (micro computers) it is very evident that the invention can be practised with electronic element of widely varying type and in a number of different manners which are equivalent. It is intended that such equivalent designs will fall under the following claims.

What we claim is:

1. Lifting body for transporting, raising or lowering objects under water, provided with means for supplying and removing a lifting gas, and being of the type in which the lifting gas has essentially the same pressure as the surrounding mass of water, and which includes a first measuring means comprising one of a pressure meter and an echo-sounder for providing a depth position signal, characterized in that the depth position signal is arranged to be compared with a preset desired depth signal to regulate the means for supplying and removing the lifting gas, and the lifting body is provided with a second measuring means for providing an acceleration signal, which is coupled to the lifting gas supply means, and a lifting implement for attachment to an object to be raised, said second measuring means comprising a dynamometer arranged in a lifting means to measure the force in the lifting means, wherein the acceleration signal is coupled to a high-pass filter, the output signal of which is arranged to be compared with a signal derived from the depth position signal and the desired depth signal, to generate a control signal for the means for supplying and removing the lifting gas.

2. Lifting body for transporting, raising or lowering objects under water, provided with means for supplying and removing a lifting gas, and being of the type in which the lifting gas has essentially the same pressure as the surrounding mass of water, and which includes a first measuring means comprising one of a pressure meter and an echo-sounder for providing a depth position signal, characterized in that the depth position signal is arranged to be compared with a preset desired depth signal to regulate the means for supplying and removing the lifting gas, and the lifting body is provided with a second measuring means for providing an acceleration signal, which is coupled to the lifting gas supply means, and a lifting implement for attachment to an object to be raised, said second measuring means comprising a dynamometer arranged in a lifting means to measure the force in the lifting means, wherein the depth position signal is coupled via an amplifier whose amplifying factor is variable depending on the mass of the load.

3. Lifting body according to claim 1, characterized in that said control signal is coupled for activation of a blow-in valve at a first polarity and for activation of a discharge valve at a polarity of the signal opposite to the first polarity.

4. Lifting body according to claim 3, characterized in that the blow-in valve is controlled by an amplifier, the amplifying factor of which is variable depending on the depth position of the lifting body.

5. Lifting body according to one of claims 1–4, characterized in that it comprises an air hose to be coupled to a compressor above the water surface, the supply of lifting gas being arranged through a controlled air valve, coupled between the compressor and the hose, the removal of lifting gas being arranged through a controlled release valve whereby the air hose can be opened to the atmosphere.

6. Lifting body according to one of claims 1–4, characterized in that the supply of lifting gas is arranged from a lifting gas source arranged at the lifting body with gas in compressed liquid or solid form, from which lifting gas can be supplied via a controlled valve or removed via another controlled valve.

7. An apparatus for moving an object through a first fluid to control the vertical distance of said object with respect to a substantially horizontal surface bounding said first fluid, said apparatus comprising:

lifting body means for exerting a vertically-directed force on said object, said lifting body including means for storing a quantity of a second fluid, said second fluid having a density different from the density of said first fluid, the magnitude of said exerted force being dependent on the quantity and density of said said stored second fluid;

first measuring means, fixed to said lifting body means, for producing a first signal indicative of the vertical distance of said object from said horizontal surface, said first measuring means including:

displacement sensing means for producing a displacement signal indicative of the distance of said object from said horizontal surface; and adaptive position regulating means, responsive to said displacement signal, for producing said first signal, said displacement signal being amplified by said regulating means by a variable amplification factor, said amplification factor being dependent on the mass of said object;

second measuring means, fixed to said lifting body means, for producing a second signal indicative of said exerted force;

comparing means, responsive to said first signal, for comparing said measured vertical distance with a preset desired vertical distance; and control means, operatively connected to said fluid storing means and responsive to said second signal and to the result of said comparison of said comparing means, for changing at least one of the quantity and the density of said stored second fluid to change the vertical distance of said object from said horizontal surface.

8. An apparatus as in claim 7 wherein:

said lifting body means includes coupling means for grasping said object; and said second measuring means is operatively connected to said coupling means for measuring the force exerted on said object by said lifting body means through said coupling means.

9. An apparatus as in claim 8 wherein said second measuring means comprises a dynamometer.

10. An apparatus as in claim 8 wherein said second measuring means includes:

acceleration sensing means for producing an acceleration signal indicative of the acceleration of said object; and integrating means for integrating said acceleration signal to produce said second signal.

11. An apparatus as in claim 10 wherein said acceleration sensing means comprises an accelerometer.

12. An apparatus as in claim 7 wherein said displacement sensing means comprises a pressure meter.

13. An apparatus as in claim 7 wherein said displacement sensing means comprises an echo sounder.

14. An apparatus as in claim 7 wherein said control means includes valve means for changing the quantity of said stored second fluid.

15. An apparatus for moving an object through a first fluid to control the vertical distance of said object with respect to a substantially horizontal surface bounding said first fluid, said apparatus comprising:

lifting body means for exerting a vertically directed force on said object, said lifting body including means for storing a quantity of a second fluid, said second fluid having a density different from the density of said first fluid, the magnitude of said exerted force being dependent on the quantity and density of said said stored second fluid;

first measuring means, fixed to said lifting body means, for producing a first signal indicative of the vertical distance of said object from said horizontal surface;

second measuring means, fixed to said lifting body means, for producing a second signal indicative of said exerted force;

comparing means, responsive to said first signal, for comparing said measured vertical distance with a preset desired vertical distance;

control means, operatively connected to said fluid storing means and responsive to said second signal and to the result of said comparison of said comparing means, for changing at least one of the quantity and the density of said stored second fluid to change the vertical distance of said object from said horizontal surface; and fluid source means for supplying said second fluid at a predetermined pressure, wherein said control means includes:

control signal generating means for producing a control signal having a first polarity when said vertical distance is to be decreased and having a second polarity when said vertical distance is to be increased; and valve means for changing the quantity of said stored second fluid in response to said control signal; and wherein said valve means comprises:

blow-in valve means, responsive to said control signal, for connecting said fluid source means to said fluid storing means to increase said stored quantity of said second fluid when said control signal is produced at said first polarity; and discharge valve means, responsive to said control signal, for exhausting a portion of said quantity of said stored second fluid from said fluid storing means to decrease the quantity of said stored second fluid when said control signal is produced at said second polarity.

16. An apparatus as in claim 15 wherein said blow-in valve means includes:

an electrically actuated valve for selectively connecting said fluid source means to said storing means; and amplifying means, responsive to said control signal produced at said first polarity and to said first signal, for controlling the degree of connection performed by said electrically acutated valve, said amplifying means having a variable amplification factor dependent upon the vertical distance of said object from said horizontal surface.

17. An apparatus as in claim 16 wherein:

said fluid source means comprises:

compressor means for pumping air from the atmosphere; and air hose means for connecting said compressor means to said blow-in valve means; and wherein said first fluid comprises water and said second fluid comprises air.

18. An apparatus as in claim 16 wherein said fluid source means includes:

reservoir means, fixed to said lifting body, for storing a reserve quantity of said second fluid; and means for connecting said reservoir means to said blow-in valve means.

19. An apparatus for controlling the vertical force exerted on an object by a lifting body, said lifting body being of the type which moves with said object through a first fluid, said lifting body including means for storing a second fluid, said second fluid having a density different from the density of said first fluid, the magnitude of said exerted force being dependent on the quantity and density of said stored second fluid, said apparatus comprising:

first measuring means, fixed to said lifting body, for producing a first signal indicative of the vertical distance of said object from a substantially horizontal surface bounding said first fluid, said first measuring means including:

displacement sensing means for producing a displacement signal indicative of the distance of said object from said horizontal surface; and adaptive position regulating means responsive to said displacement signal, for producing said first signal, said displacement signal being amplified by said regulating means by a variable amplification factor, said amplification factor being dependent on the mass of said object;

second measuring means, fixed to said lifting body, for producing a second signal indicative of said exerted force;

comparing means, responsive to said first signal, for comparing said measured vertical distance with a preset desired vertical distance; and control means, operatively connected to said fluid storing means and responsive to said second signal and to the result of said comparison of said comparing means, for changing at least one of the quantity and the density of said stored second fluid to control said vertical distance of said object from said horizontal surface.

20. An apparatus as in claim 19 wherein:

said lifting body includes a coupling device for grasping said object; and said second measuring means measures the force exerted on said object by said lifting body through said coupling means.

21. An apparatus as in claim 20 wherein said second measuring means comprises a dynamometer.

22. An apparatus as in claim 20 wherein said second measuring means includes:

acceleration sensing means for producing an acceleration signal indicative of the accleration of said object; and integrating means for integrating said acceleration signal to produce said second signal.

23. An apparatus as in claim 22 wherein said acceleration sensing means comprises an accelerometer.

24. An apparatus as in claim 19 wherein said displacement sensing means comprises a pressure meter.

25. An apparatus as in claim 19 wherein said displacement sensing means includes an echo sounder.

26. An apparatus as in claim 19 wherein said control means includes valve means, operatively connected to said fluid storing means, for changing the quantity of said stored second fluid.

27. An apparatus for controlling the vertical force exerted on an object by a lifting body, said lifting body being of the type which moves with said object through a first fluid, said lifting body including means for storing a second fluid, said second fluid having a density different from the density of said first fluid, the magnitude of said exerted force being dependent on the quantity and density of said stored second fluid, said apparatus comprising:

first measuring means, fixed to said lifting body, for producing a first signal indicative of the vertical distance of said object from a substantially horizontal surface bounding said first fluid;

second measuring means, fixed to said lifting body, for producing a second signal indicative of said exerted force;

comparing means, responsive to said first signal, for comparing said measured vertical distance with a preset desired vertical distance;

control means, operatively connected to said fluid storing means and responsive to said second signal and to the result of said comparison of said comparing means, for changing at least one of the quantity and the density of said stored second fluid to control said vertical distance of said object from said horizontal surface; and fluid source means for supplying said second fluid at a predetermined pressure, wherein said control means includes:

control generating means for producing a control signal having a first polarity when said vertical distance is to be decreased and having a second polarity when said vertical distance is to be increased; and valve means, operatively connected to said fluid storing means, for changing the quantity of said stored second fluid in response to said control signal; and wherein said valve means comprises:

blow-in valve means, responsive to said control signal, for connecting said fluid source means to said fluid storing means to increase said stored quantity of said second fluid when said control signal is produced at said first polarity; and discharge valve means, responsive to said control signal, for exhausting some of said second fluid from said fluid storing means to decrease said stored quantity of said second fluid when said control signal is produced at said second polarity.

28. An apparatus as in claim 27 wherein said blow-in valve means includes:

an electrically actuated valve for selectively connecting said fluid source means to said fluid storing means; and amplifying means, responsive to said control signal produced at said first polarity and said first signal, for controlling the degree of connection performed by said electrically actuated valve, said amplifying means having a variable amplification factor dependent upon said distance of said object from said horizontal surface.

29. An apparatus as in claim 27 wherein said fluid source means comprises:

compressor means for pumping air from the atmosphere at a predetermined pressure; and air hose means for supplying said air to said blow-in valve means; and wherein said first fluid comprises water and said second fluid comprises air.

30. An apparatus as in claim 27 wherein said fluid source means includes:

reservoir means, fixed to said lifting body, for storing a reserve quantity of said second fluid at said predetermined pressure; and means for connecting said reservoir means to said blowing valve means.

* * * * *